US009482450B2

(12) United States Patent
Hugenroth

(10) Patent No.: US 9,482,450 B2
(45) Date of Patent: Nov. 1, 2016

(54) ERICSSON CYCLE DEVICE IMPROVEMENTS

(71) Applicant: INVENTHERM, LLC, Baton Rouge, LA (US)

(72) Inventor: Jason Hugenroth, Baton Rouge, LA (US)

( * ) Notice: Subject to any disclaimer, the term of this patent is extended or adjusted under 35 U.S.C. 154(b) by 118 days.

(21) Appl. No.: 14/356,813

(22) PCT Filed: Nov. 7, 2012

(86) PCT No.: PCT/US2012/063873

§ 371 (c)(1),
(2) Date: May 7, 2014

(87) PCT Pub. No.: WO2013/070704

PCT Pub. Date: May 16, 2013

(65) Prior Publication Data

US 2014/0311167 A1 Oct. 23, 2014

Related U.S. Application Data

(60) Provisional application No. 61/628,790, filed on Nov. 7, 2011.

(51) Int. Cl.
*F25B 9/14* (2006.01)
*F25B 9/06* (2006.01)

(52) U.S. Cl.
CPC . *F25B 9/14* (2013.01); *F25B 9/06* (2013.01); *F25B 2309/1401* (2013.01); *F25B 2400/15* (2013.01)

(58) Field of Classification Search
CPC .... F25B 9/14; F25B 9/06; F25B 2309/1401; F25B 2400/15
USPC ..... 60/39.6, 643, 645, 650, 684; 62/87, 402
See application file for complete search history.

(56) References Cited

U.S. PATENT DOCUMENTS

| | | | | |
|---|---|---|---|---|
| 4,009,573 | A | 3/1977 | Satz | |
| 4,414,812 | A | 11/1983 | Parry | |
| 4,984,432 | A | 1/1991 | Corey | |
| 5,473,899 | A | 12/1995 | Viteri | |
| 5,932,940 | A * | 8/1999 | Epstein | F01D 5/28 257/414 |
| 6,470,683 | B1 * | 10/2002 | Childs | B01D 61/025 60/39.6 |
| 6,672,063 | B1 * | 1/2004 | Proeschel | F02G 1/04 60/616 |
| 7,124,585 | B2 | 10/2006 | Kim et al. | |

(Continued)

FOREIGN PATENT DOCUMENTS

JP 2001-165040 A 6/2001

OTHER PUBLICATIONS

PCT/US2012/063873 International Search Report.

(Continued)

*Primary Examiner* — Hoang Nguyen
(74) *Attorney, Agent, or Firm* — Fay Sharpe LLP

(57) ABSTRACT

The present disclosure relates to improvements to thermodynamic devices that approximate the Ericsson cycle, Brayton cycle, or regenerated Brayton cycle. These cycles and various ways of implementing them are known in the art. They can operate as engines or refrigerators. The Ericsson cycle is attractive since it can theoretically operate at the Carnot efficiency, which is the maximum possible efficiency for a heat engine or refrigerator.

33 Claims, 11 Drawing Sheets

(56) References Cited

U.S. PATENT DOCUMENTS

| | | | | |
|---|---|---|---|---|
| 7,401,475 | B2 | 7/2008 | Hugenroth et al. | |
| 2001/0025478 | A1 | 10/2001 | Fineblum | |
| 2002/0066270 | A1* | 6/2002 | Rouse | F01K 23/10 60/670 |
| 2004/0103637 | A1* | 6/2004 | Maisotsenko | F01K 21/047 60/39.59 |
| 2005/0257523 | A1 | 11/2005 | Proeschel | |

OTHER PUBLICATIONS

Kim, Youngmin, et al., Energy and Exergy Analysis of a Micro Compressed Air Energy Storage and Air Cycle Heating and Cooling System (2008). International Refrigeration and Air Conditioning Conference. Paper 950, Purdue University, Purdue e-Pubs (http://docs.lib.purdue.edu/iracc/950).

Fernandez-Pello, "Micro-Power Generation Using Combustion: Issues and Approaches", *Colloquium: 14. New Concepts in Combustion Technology. Micro-combusters*, Twenty-Ninth International Symposium on Combustion, Jul. 21-26, 2002, Sapporo, Japan.

Elgendy, "Chapter 60, Analytical Determination for the Performance of a New Power Generation Technology", *Power Generation, Energy Management & Environmental Sourcebook*, The Association of Energy Engineers, 1992, pp. 333-338.

Elgendy, "Chapter 98, Variable Speed Scroll Ericsson Engine Heat Pump System", *Energy and Environmental Strategies for the 1990's*, Atlanta, GA, pp. 609-615.

* cited by examiner

ERICSSON CYCLE DEVICE IMPROVEMENTS

This application is a submission under 35 U.S.C. 371 of International Application No. PCT/US2012/063873, International Filing Date 7 Nov. 2012 and claims priority from U.S. provisional application Ser. No. 61/628,790, filed Nov. 7, 2011, the disclosure of which is expressly incorporated herein by reference.

BACKGROUND OF THE DISCLOSURE

The present disclosure relates to improvements to thermodynamic devices that approximate the Ericsson cycle, Brayton cycle, or regenerated Brayton cycle. These cycles and various ways of implementing them are known in the art. They can operate as engines or refrigerators. The Ericsson cycle is attractive since it can theoretically operate at the Carnot efficiency, which is the maximum possible efficiency for a heat engine or refrigerator.

Brayton cycle devices, such as gas turbine engines and Brayton cycle cryocoolers have achieved widespread commercial use. However, Ericsson cycle devices have not achieved widespread commercial success. A principal difficulty of implementing a practical device that operates in a manner substantially similar to the Ericsson cycle is the requirement for isothermal or near isothermal compression and expansion of the working fluid. When a gas is compressed, the temperature of the gas increases. To keep the temperature of the gas constant during compression, the gas must be cooled while it is compressed. In practice, isothermal compression of a gas is extremely difficult to achieve because, for practical compression machines, the area available for heat transfer is very small and the compression process occurs very quickly. A compressor could be made with a large heat transfer area and a very slow compression process. This, however, would typically result in a large and expensive device that was not commercially practical.

The situation is similar for the expansion process where the temperature of the gas decreases as it expands and it is typically not practical to add a significant amount of heat to the gas during the expansion process. In lieu of heating and cooling the gas during the expansion and compression processes, respectively, external heat exchangers can be used for adding and rejecting heat to the system. This arrangement results in a Brayton cycle device.

A combination of heat addition external to the expansion and compression process and during the expansion and compression process results in a cycle that has Ericsson cycle and regenerated Brayton cycle characteristics. Here this type of hybrid cycle will be referred to as an Ericsson cycle for convenience.

Various schemes have been devised to overcome the challenge of effective heat addition during the expansion processes and heat rejection during the compression process. Y. A. M. Elgendy drafted the study titled ANALYTICAL DETERMINATION FOR THE PERFORMANCE OF A NEW POWER GENERATION TECHNOLOGY and proposed using a scroll compressor and expander in an Ericsson cycle arrangement. This disclosure is expressly incorporated herein by reference. Scroll machinery has a relatively large surface area available for heat transfer compared with other technologies such as reciprocating compressors or turbomachinery. Elgendy also proposed using heat pipes or other means to increase the rate of heat transfer. Kim et al. disclosed in U.S. Pat. No. 7,124,585 (expressly incorporated herein by reference) a similar Ericsson cycle arrangement with scroll machinery. Corey (U.S. Pat. No. 4,984,432) and Hugenroth et al. (U.S. Pat. No. 7,401,475) (both of which are expressly incorporated herein by reference) disclosed methods of using liquid flooding during the compression and expansion processes to approach isothermal compression and expansion. Hugenroth et al. used scroll or screw machinery due to their ability to tolerate liquid flooding.

SUMMARY OF THE DISCLOSURE

In accordance with one aspect of the present disclosure, provided is a thermodynamic system that approximates an Ericsson cycle.

In one preferred embodiment of the present disclosure, the system includes a scroll type compressor that is configured to compress a fluid. The scroll type compressor is in communication with a cold heat exchanger to reject heat from the gas such that isothermal compression of the gas is approached. A scroll type expander is configured to expand the gas that is in communication with a hot heat exchanger to introduce heat to the gas such that isothermal expansion is approached. A recuperator is provided in fluid communication with the compressor and expander through a series of conduits configured to transfer heat between the gas received from the compressor and the gas received from the expander. The compressor and expander are contained in a housing such that a seal is formed around a periphery of the compressor and expander. A control system is configured to control a level of power output of the system In accordance with another aspect of the present disclosure, the controller is configured to manipulate the output power of the system by adjusting the flow of gas through at least one bypass line or a bypass and reservoir line such that output power is reduced when the gas flow is interrupted through the bypass line or trapped in the reservoir while output power is increased as the gas flows out of the bypass line or is released from the reservoir.

In accordance with yet another aspect of the present disclosure, provided is a method of generating power through a thermodynamic system that approximates an Ericsson cycle. Initially, a gas is compressed with a scroll type compressor that is in communication with a cold heat exchanger to reject heat from the gas such that isothermal compression is approached thereby generating a compressed gas. The compressed gas is passed through a recuperator that is in communication with the scroll type compressor and a scroll type expander through a series of conduits that is configured to transfer heat between gas received from the compressor and gas received from the expander. The compressed gas is then expanded within the scroll type expander that is in communication with a hot heat exchanger to introduce heat to the gas such that isothermal expansion is approached thereby generating an expanded gas. The expanded gas is passed through the recuperator and reintroduced to the compressor. The flow of gas is selectively controlled by re-routing the compressed gas, and/or the expanded gas through at least one bypass line to control a level of power output generated.

DETAILED DESCRIPTION OF THE PREFERRED EMBODIMENTS

Figure 1:
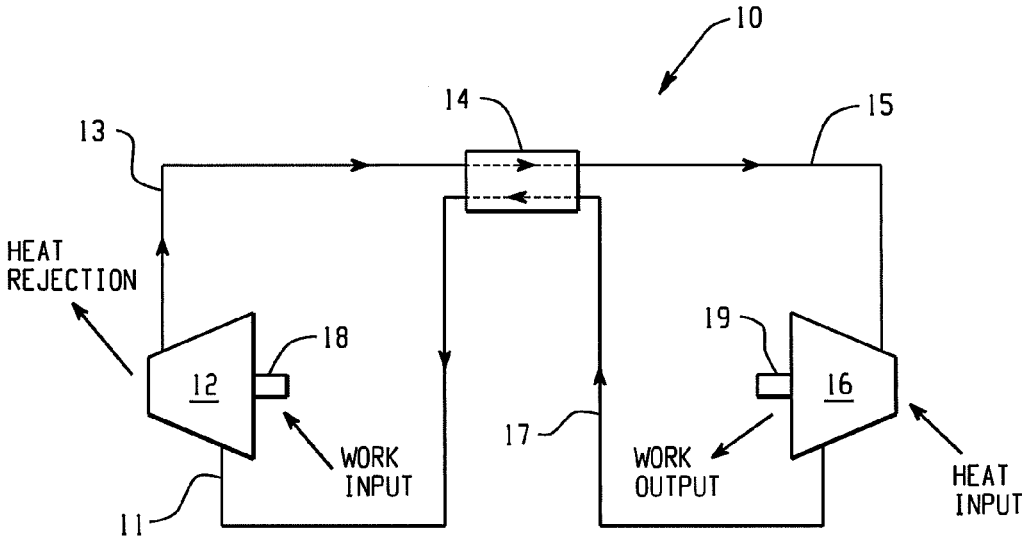
Fig. 1 PRIOR ART
FIG. 1 is a basic schematic illustration of an Ericsson cycle thermodynamic system.

One advantage of using scroll compressors in an Ericsson cycle is that they have a relatively large surface area compared with some other compressor technologies. However, with the exception of liquid flooding it is still very difficult, even with a scroll compressor, to approach isothermal compression and expansion processes. This is the case for macro size devices. However, for meso and micro scale devices the ability to approach isothermal compression and expansion processes becomes quite practical. This is due to scaling effects. For example, the displacement volume of the compressor varies with the cube of some characteristic length associated with the compressor, while the heat transfer area varies with the square of the characteristic length. Therefore, the ratio of heat transfer area to displacement volume increases as the size of the compressor decreases. The terms mesoscale and microscale used herein describe devices where the compressor or expander characteristic length ranges from a few millimeters to a few centimeters. More specifically, the characteristic length of the compressor, for example, could range from about 0.1 mm to about 5 cm. However, a more practical range of characteristic lengths would be from about 1 mm to 4 cm. The characteristic length is a representative dimension. Using the compressor again as an example, it can be thought of as the diameter of a sphere that would contain the compressor. It should be acknowledged that a shaft, fluid tubing, wiring or other protuberances could extend beyond said sphere without impacting said characteristic length. The term meso generally refers to something larger than micro. Herein the terms will be used interchangeably.

Mesoscale to microscale engines have numerous potential uses. When coupled with an electric generator, the engines can be used to replace batteries in numerous applications. A few examples include laptop computers, portable oxygen concentrators, power tools, and flashlights. A meso or micro scale Ericsson engine could also be used in a hybrid arrangement, similar to hybrid cars where the engine is used to charge a battery pack, for example. A potential use would be battery powered mobility scooters or wheelchairs. Direct use of shaft power output of the engine can also be used for numerous applications. One potential application is for micro unmanned aerial vehicles. The power output of this engine technology could range from about 0.1 W to 250 W. A more practical range would be from about 1 W to 150 W.

A mesoscale to microscale Ericsson power generation system (or MEPS) has many potential advantages over other technologies, such as batteries. MEPS can use liquid fuels that have energy densities substantially larger than the best battery technology. A MEPS could operate 10-20 times longer than a battery of equivalent size and weight. Unlike batteries, a MEPS does not need to recharge. It can simply be refueled. Since Ericsson cycle engines rely on an external heat addition, many fuel sources could be used. This includes liquid fuels, gaseous fuels, solid fuels (e.g. biomass) and solar thermal energy. This is a significant advantage over technologies such as fuel cells that are very fuel specific.

The advent of high precision micro and meso-scale fabrication techniques has, in principle, made possible the development of micro power generation systems (MPGS) that operate on traditional thermodynamic cycles such as gas turbine (Brayton) and Otto cycles (spark ignition). These combustion based MPGSs attempt to capitalize on the high energy densities provided by hydrocarbon fuels.

The goal of developing a practical combustion based MPGS has proven elusive. Numerous difficulties are encountered when attempting to scale down conventional engine technologies. Some difficulties are related to the fabrication of small engine components. The dominant technical challenge, however, is overcoming the detrimental impact of scaling on thermophysical processes that govern the operation of engines. Space constraints preclude a detailed technical discussion of each effect and its origin. However, the dominant themes will be addressed.

Transport phenomenon (i.e. fluid dynamics and heat transfer) are significantly different at these length scales when compared to their maco-scales cousins (e.g. automobile engines). This reality necessitates a rethinking of what a combustion based MPGS should look like.

As the characteristic length scale of an engine decreases the power density increases. This occurs because the volume of an engine varies with the cube of the characteristic length while the mass flow rate, which is a function of the flow area, varies with the square of the characteristic length. This is a favorable effect of scaling since high power density is a goal of all engine design.

The small length scale of the solid components in combustion based MPGSs results in a Fourier number that is relatively large (on the order of 0.001 and greater). This means that temperature gradients in solid parts dissipate quickly. Or in other words, the temperature throughout these components is very uniform. It is also the case that the ratio of surface area to volume for these components increases with decreasing length scale, again, due to the variation of volume with the cube of the characteristic length and variation of surface area with the square of the same length. The result is that the heat flux between engine components and the engine working fluids are very large. This detrimentally impacts the performance of technologies that have been previously investigated. However, it is an advantage for the disclosed MEPS technology.

Heat flux rates also have a significant impact on the combustion process in MPGSs. As the combustion chamber volume decreases the heat loss from the combustor increases until the heat loss exceeds the heat release from the combustion process. Once this occurs combustion can no longer be maintained and the flame is quenched. This characteristic length is known as the quenching distance. The quenching distance is not a fundamental limitation. It can be overcome, for example by heating the walls of the combustion chamber externally so that heat loss is minimized. Researchers have had success maintaining combustion in small scale combustors by recirculating exhaust gases around the exterior of the combustion chamber. This has been discussed by C. Fernandez-Pello in MICRO-POWER GENERATION USING COMBUSTION: ISSUES AND APPROACHES (the disclosure of which is incorporated herein by reference).

In addition to the quenching problem, the residence time of the fuel in micro-combustors presents problems. Specifically, the physical time available for combustion (residence time) must be greater than the time required for the chemical reaction to occur (chemical time). Short chemical times are assured by high temperature combustion, which is hindered by heat loss from the combustor. Sufficient mixing and diffusion times between the fuel and oxidizer are also necessary. The chemical time also increases substantially as you move from "light" fuels such as hydrogen to "heavier" fuels such as methanol. This is a substantial stumbling block for intermittent combustion engines such as Otto cycle engines (i.e. spark ignition engines), and Diesel cycle engines.

The increased surface area that causes quenching in a gas-phase combustor is beneficial for catalytic combustion where the reaction occurs at the solid interface of the catalyst itself. However, catalytic combustion times are generally slower than gas-phase combustion times. Despite the difficulties researchers have successfully built catalytic and gas-phase micro-combustors using a range of fuels. These combustors operate continuously, not intermittently as required for Otto and Diesel cycles.

Various types of combustion based MPGSs have been investigated by researchers. These engines vary in both chosen thermodynamic cycles and the design of the machinery for implementing the cycle. The ultimate objective of these research efforts is invariably to produce portable, cost effective power generation systems that exceed the energy density of batteries. A few well known research programs are mentioned here. However, this is not meant to be an exhaustive list of relevant research projects.

The Massachusetts Institute of Technology (MIT) Gas Turbine Laboratory was developing a MEMS-based gas turbine powered generator. The device was intended to produce approximately 10 W. Several individual components were built and tested independently. The unit never produced net power.

There are several fundamental challenges related to both the concept of a micro-gas turbine and the particular design features of the MIT engine. Turbomachinery (i.e. turbines and dynamic or centrifugal compressors) work by converting flow kinetic energy into pressure and vice versa. For a dynamic compressor, the pressure ratio that can be achieved is proportional to the tip speed. As the rotor diameter decreases the rotational speed of the rotor must increase to maintain a given pressure ratio. For a gas turbine engine the efficiency is directly proportional to pressure ratio. Therefore, exceedingly high rotational speeds are required to achieve necessary pressure ratios. This is before any non-ideal factors are considered. The MIT microturbine rotates at speeds of about 1.3 million RPM. In the MIT micro-turbine design the turbine and compressor rotor blades are fabricated on opposite sides of the same rotor disk. For reasons previously discussed large heat fluxes between the gas in the turbine and compressor are expected. This heat transfer is extremely detrimental to performance. The catalytic combustor used for this engine has operated as a stand-alone component. When operating on the engine, heat transfer from the combustor to the compressor intake air has been reported as a dominant problem. As previously, stated this microengine technology never produced a net power output. Fundamentally the failure was due to heat transfer between engine components and excessive leakage in the compressor and expander at high pressure ratios.

UC Berkeley Combustion Laboratories had a research program dedicated to the development of meso-scale and micro-scale rotary Wankel-type engine. The larger version of this Otto cycle engine had a diameter of approximately 10 mm. This unit was bench tested using a hydrogen/air mixture. A net power output of 3.7 watts was achieved at 9000 RPM with a thermal efficiency of approximately 0.2%. A major reason for the poor performance was attributed to gas leakage across the apex seals. That is, leakage of the compressed air and combustion products out of the compression chamber. Heat transfer from the combustion chamber to the compression chamber would also be a significant problem.

Internal leakage is a problem for positive displacement and dynamic compressors at small scales. Leakage-path-length scales linearly with the characteristic length while volume scales with the cube of the characteristic length. Therefore, the ratio of the leakage-path length to the volume of the compressor increases substantially as the compressor is miniaturized. If contact seals are used, sliding friction scales in an equally negative manner.

Assuming that the engine components are being made to the highest practical tolerances (i.e. minimum leakage gaps) there are two ways to reduce leakage. First, the residence time of the gas in the engine can be decreased. In other words it can be run at a higher speed. Or, second, the pressure differential can be decreased, since leakage rates are a function of pressure differential. For the former, reducing the residence time means that the chemical time must be sufficiently short for complete combustion. This is a very difficult problem to overcome in a small spark ignition engine at meso and micro scales. Therefore, decreasing the residence time is probably not practical for the Wankel engine. Decreasing the pressure differential is also not practical, since Otto and Diesel cycle efficiency increase with pressure ratio.

Researchers at the University of Minnesota investigated a free-piston homogeneous charge compression ignition (HCCI) engine. HCCI engines use the heat of compression to ignite a premixed fuel air mixture. This type of ignition mechanism alleviates the problems associated with flame quenching. In a "free-piston" arrangement there is no connecting rod or crankshaft. The piston simply oscillates back and forth. The oscillating motion of the piston causes a coil to oscillate in a stationary magnetic field or vice versa. This is known as a linear generator. There are many challenges with this type of engine for MPGSs. One is the need for very small inlet and exhaust valves and a means to control them. Another is control of the combustion process, which is also the dominant issue for macro scale HCCI engines.

This particular HCCI engine was an Otto cycle engine which means that the efficiency increases with pressure ratio. As stated previously, it is difficult to control leakage in high pressure ratio engines at micro and meso-scales. During testing, a five micron gap between the piston and cylinder wall resulted in substantial leakage rates.

The combustion based MPGSs that have been discussed all have significant scaling related deficiencies that reduce the likelihood that technical and, therefore, commercial success will be achieved. The guiding principle of the disclosed MEPS is to take advantage of the effects of scaling for the purpose of enhancing operation of the engine or refrigerator, rather than fighting its effects. Specifically, the small size of the compressor and expander make approaching isothermal compression and expansion practical. The fact that compression and expansion take place in separate devices that are physically separated substantially limits heat leakage effects associated with other technologies. The external combustion process eliminates the challenges associated with intermittent combustion on small scales. Also, the efficiency of the ideal Ericsson cycle is independent of the system pressure ratio. This greatly reduces the detrimental impact of leakage on small scale compressors and expanders. In addition to the physical separation of the compressor and expander, other attributes will be disclosed that greatly reduce undesirable heat transfer between the compressor and expander.

A MEPS can use a number of different compressor and expander technologies. These include, reciprocating, linear, scroll machinery, screw machinery, rolling piston machinery, swing rotary machinery, sliding vane machinery, trochoidal machinery, turbomachinery, diaphragm machinery and others known in the art. It can also be advantageous to use different technologies for the compressor and expander. It can also be advantageous to use multiple stages of compression and or expansion. Scroll compressors, however, have certain advantages for the MEPS.

Scrolls do not require valves to operate. This contributes to their quiet and reliable operation. They have a two-dimensional geometry that is amenable to micro-manufacturing techniques. There are a minimum number of moving parts, possibly just one depending on the design configuration. Scrolls are well known for having high volumetric efficiencies, typically in the range of 95% (i.e., low leakage rates). The sliding velocity between the contact points of the fixed and orbiting scrolls is very low, reducing wear and lubrication issues. In addition, the contact between the scroll flanks can be totally eliminated, as in the case of some oil-less scroll compressor designs. Since scroll compressors are rotary machines, without reciprocating masses, the compressor is easy to dynamically balance, resulting in very low vibration. Also, since the total pressure differential from outlet to inlet is divided among multiple compression pockets leakage losses are reduced.

Scroll expanders are simply scroll compressors operating in reverse. That is, high pressure gas enters at the center of the scrolls and moves toward the periphery as the orbiting-scroll orbits and shaft work is output. Again, no valves are needed to control the flow.

The closed cycle arrangement disclosed for the MEPS is not a fundamental requirement, but it has several practical advantages. For example, the working fluid does not need to be air. This is advantageous since the thermophysical properties of gases such as helium result in better cycle efficiencies. Also, since the cycle is closed the compressor inlet pressure can be greater than atmospheric pressure. For a given pressure ratio a higher inlet pressure results in higher power density for the engine. The rotary motion, closed cycle design and external combustion process also attribute to a very quiet vibration free engine. This is very important for many commercial applications.

While the preceding discussion has primarily focused on engine technologies, the disclosed system is equally well suited for micro refrigeration applications with many benefits over existing technologies.

As briefly described above, the disclosed system is described in reference to improvements to thermodynamic systems that employ Ericsson or Brayton cycles. Prior art has disclosed basic Ericsson cycle engine and refrigerator concepts. The current disclosure addresses improvements related to control of engine power output, engine starting, means of providing heat addition and rejection, lubrication, engine generator configuration, and others.

In principle the engine can operate using any gas as the working fluid. Examples include air, argon, xenon, helium, hydrogen, neon, etc., though others could also be used. While it is generally anticipated that the fluid will remain a gas during operation of the system, there are potential advantages to using a condensable fluid. For example, condensation of the fluid during the compression process would enhance isothermal operation since condensation of a pure substance occurs at a constant temperature. A similar effect can be realized in the expander. It is also possible to use a blend of fluids to tailor thermophysical properties such that engine or refrigerator performance is enhanced. Those skilled in the art will appreciate that suitable temperatures, pressures, etc., for the operation of the systems will depend on the particular fluid or fluids used.

A liquid that is substantially non-volatile can also be circulated within the system to provide a number of benefits. For example, a liquid lubricant can be used to reduce friction between moving parts. In addition, it is widely recognized that liquids are good at sealing leakage gaps that exist inside most compressor and expander technologies. Sealing leakage gaps improves the efficiency of these components.

For engine applications with very high source temperatures, lubricating liquids may vaporize or decompose inside the engine. One feature of the disclosed system is the use of solid phase dry lubricant powders in the engine. Examples of suitable dry lubricants include graphite, molybdenum disulfide, tungsten disulfide, and hexagonal boron nitride, although this list is not intended to be exhaustive and other examples may be sued without departing from the scope and intent of the present disclosure. The small physical size of a micro to meso scale engine and the fact that the working fluid flows in a continuous closed loop makes it possible for a dry powdered lubricant to remain entrained with the flow, thus, protecting the engine from excessive wear.

Scroll-type compressors and expanders (i.e. scroll machinery) will be described in reference to some embodiments of this disclosure. The construction and operation of such compressors and expanders are well documented in the art, and therefore will not be repeated here for purposes of brevity.

FIG. 1 shows a schematic representation of an Ericsson cycle engine 10. An inlet gas stream 11 at a relatively low temperature and low pressure enters the compressor 12. A work input is required at the shaft 18 to compress the gas. During compression heat is rejected to a low temperature sink (identified as "heat rejection"). Gas stream 13 exits the compressor ideally at the same temperature as gas stream 11, but at a relatively high pressure. Gas stream 13 enters a recuperator 14 where it absorbs heat from gas stream 17, which is at a relatively low pressure and high temperature. Gas stream 15 exits the recuperator 14 at a relatively high temperature and high pressure. Gas stream 15 enters an expander 16 where work is extracted from shaft 19 while heat is absorbed by the expander 16 from a high temperature source (identified as "heat input"). The gas stream 17 exits the expander at a relatively low pressure and ideally at the same temperature as gas stream 15. Gas stream 17 enters the recuperator 14 where it rejects heat to gas stream 13 entering the recuperator. The work output from shaft 19 exceeds the work input to shaft 18 and the heat input to expander 16 exceeds the heat rejected from compressor 12. In this way, a net power output is produced in accordance with the laws of thermodynamics.

Figure 2:
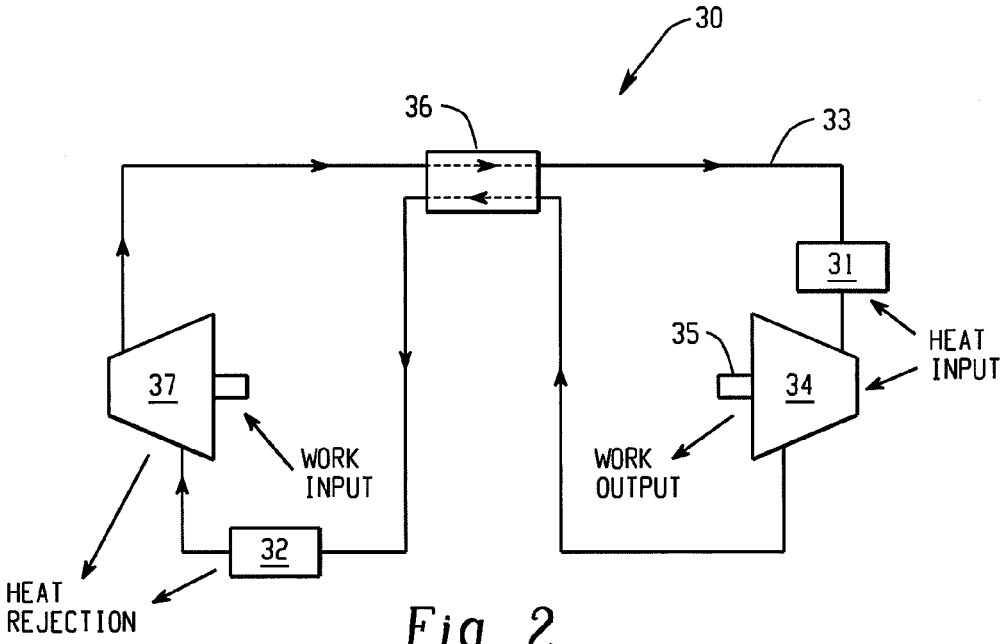
Fig. 2 PRIOR ART
FIG. 2 is a prior art schematic illustration of one embodiment of an Ericsson cycle thermodynamic system.

FIG. 2 shows a schematic representation of an Ericsson cycle engine 30. This embodiment is similar to Ericsson cycle engine 10 of FIG. 1 except that additional heat exchangers are added to the system. Hot heat exchanger 31 provides a means for adding heat to gas stream 33 before it enters the expander 34. In practice, a true isothermal process can be approached but not achieved exactly. Hot heat exchanger 31 provides a means to input additional heat into the system, which results in additional work output from the shaft 35. Similarly, since the recuperator 36 does not transfer heat perfectly and the compressor 37 is not perfectly isothermal, cold heat exchanger 32 provides a means for rejecting heat from the system, thus reducing the power input to compressor 37. The greater the percentage of the total heat input to the hot heat exchanger 31, and the greater the percentage of the total heat rejection from cold heat exchanger 32, the more the cycle behaves as a regenerated Brayton cycle.

Figure 3:
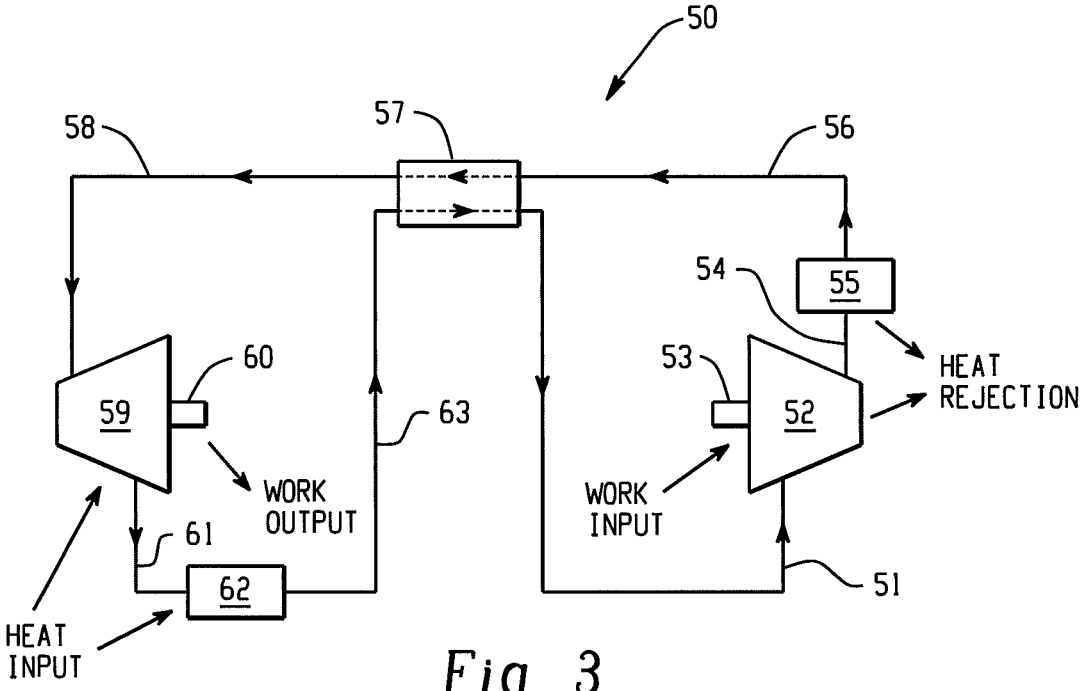
Fig. 3 PRIOR ART
FIG. 3 is a prior art schematic illustration of the reverse Ericsson cycle thermodynamic system (refrigerator).

FIG. 3 shows a schematic representation of an Ericsson cycle refrigerator 50. The refrigerator could alternately be referred to as a heat pump, cooler, cryocooler or other terms used to describe the same cycle. In this embodiment a gas stream 51 at a relatively high temperature and low pressure enters the compressor 52 where a work input to the shaft 53 compresses the gas isothermally or nearly isothermally. Gas stream 54 exits the compressor 52 at a relatively high temperature and pressure. During compression heat is rejected to a high temperature sink (identified as "heat rejection"). The gas stream 54 enters the hot heat exchanger 55 where, optionally, additional heat is rejected from hot heat exchanger 55 to a high temperature sink (again, identified as "heat rejection"). Gas stream 56 enters the recuperator 57 where it rejects heat to low pressure low temperature gas stream 63. Gas stream 58 exits the recuperator 57 at a relatively high pressure and low temperature. Gas stream 58 enters the expander 59 where it is expanded while absorbing heat from a low temperature source (identified as "heat input"). A work output is extracted from shaft 60. Gas stream 61 exits the expander 59 at a relatively low pressure and temperature. Gas stream 61 enters the cold heat exchanger 62 where, optionally, additional heat (identified as "heat input") is absorbed from a low temperature source. Gas stream 63 enters the recuperator 57 where it absorbs heat from gas stream 56. The work input to the compressor 53 exceeds the work output of the expander 59. The net work input affects a movement of heat from a low temperature source to a high temperature sink in accordance with the laws of thermodynamics.

The embodiments shown in FIGS. 1 through 3 are known in the art.

Figure 4:
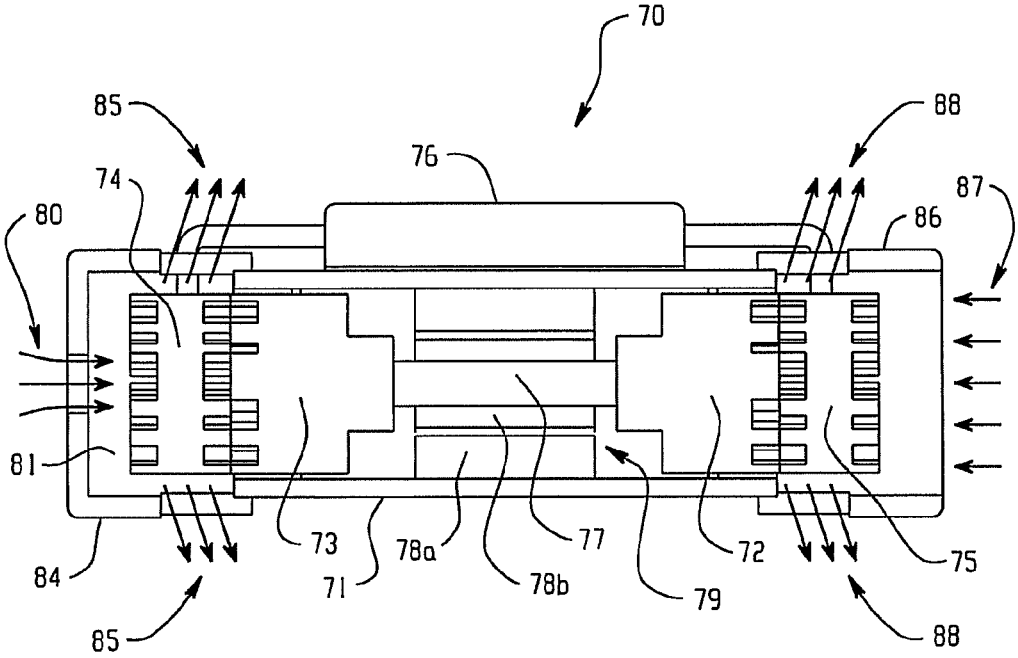
FIG. 4 is a cross sectional view of the thermodynamic system of the present disclosure.

FIG. 4 is one embodiment of the Ericsson cycle engine 70 of the present disclosure. It has functional similarities to the schematic shown in FIG. 2, and additional features have been added. The Ericsson cycle engine 70 contains a compressor 72, an expander 73, a hot heat exchanger 74, a cold heat exchanger 75, and a recuperator 76. Piping or passages (mostly not shown) is arranged in the same general manner as the gas streams in Ericsson engine 30 of FIG. 2.

The compressor 72 and expander 73 are contained in a common housing 71. A common rotatable shaft 77 is mated between the compressor 72 and expander 73. An electric generator includes a stator 78*a* and a rotor 78*b* where the rotor 78*b* is affixed to the shaft 77. The electric generator stator 78*a* is affixed to the housing in operative relation to the rotor 78*b*. The electric generator 79 can be of any type that converts a mechanical work input into another form of energy (typically electrical energy). The housing 71 and shaft 77 could be of any material that could be devised to function properly. However, it is desirable for these materials to be thermal insulators to minimize heat transfer from the expander 73 to the compressor 72. Possible materials include engineering plastics such as polyimides and polyamide-imides and ceramics such as alumina and zirconia. Metal alloys can also be used. The compressor 72 and expander 73 preferably have augmented heat transfer surfaces. These surfaces can be of any means known in the art. Examples include fins of various geometries and heat pipes mated to or integral with the surfaces of the compressor 72 and expander 73. Further heat transfer augmentation means could also be used.

A fuel air mixture 80 enters the combustion chamber 81 where it reacts releasing heat that is absorbed by the hot heat exchanger 74 and expander 73. A cap 84 encloses the combustion chamber. The cap 84 acts to limit heat loss from the combustor and to control the flow of reactant (inlet) and product (outlet) gases for efficient combustion and heat transfer. A conventional combustion process can be used in the combustor 81. Alternately, a catalytic combustion or catalytically assisted combustion can be used. For example, a catalyst can be coated on the surfaces of the hot heat exchanger 74 and expander 73 so that the chemical reaction and release of thermal energy occurs directly on the surfaces where heat input is desired. Various other options will be obvious to those skilled in the art. Product (outlet) gases 85 are expelled through openings in the cap 84.

Cooling fluid 87 flows across the cold heat exchanger 75 and compressor 72. Cap 86 serves to direct the flow and can contain a cooling fan (not shown) to provide forced-flow cooling. A cooling fan (not shown) can also be provided external to the cap 86. The housing 71 forms a seal around the periphery of the compressor 72 and expander 73. This results in a fully sealed (i.e. hermetic) design, which has several benefits. For example, shaft seals that tend to leak and wear out over time are not needed. Also, the chance of contaminating the working fluid with air or other gases is minimized.

Figure 5:
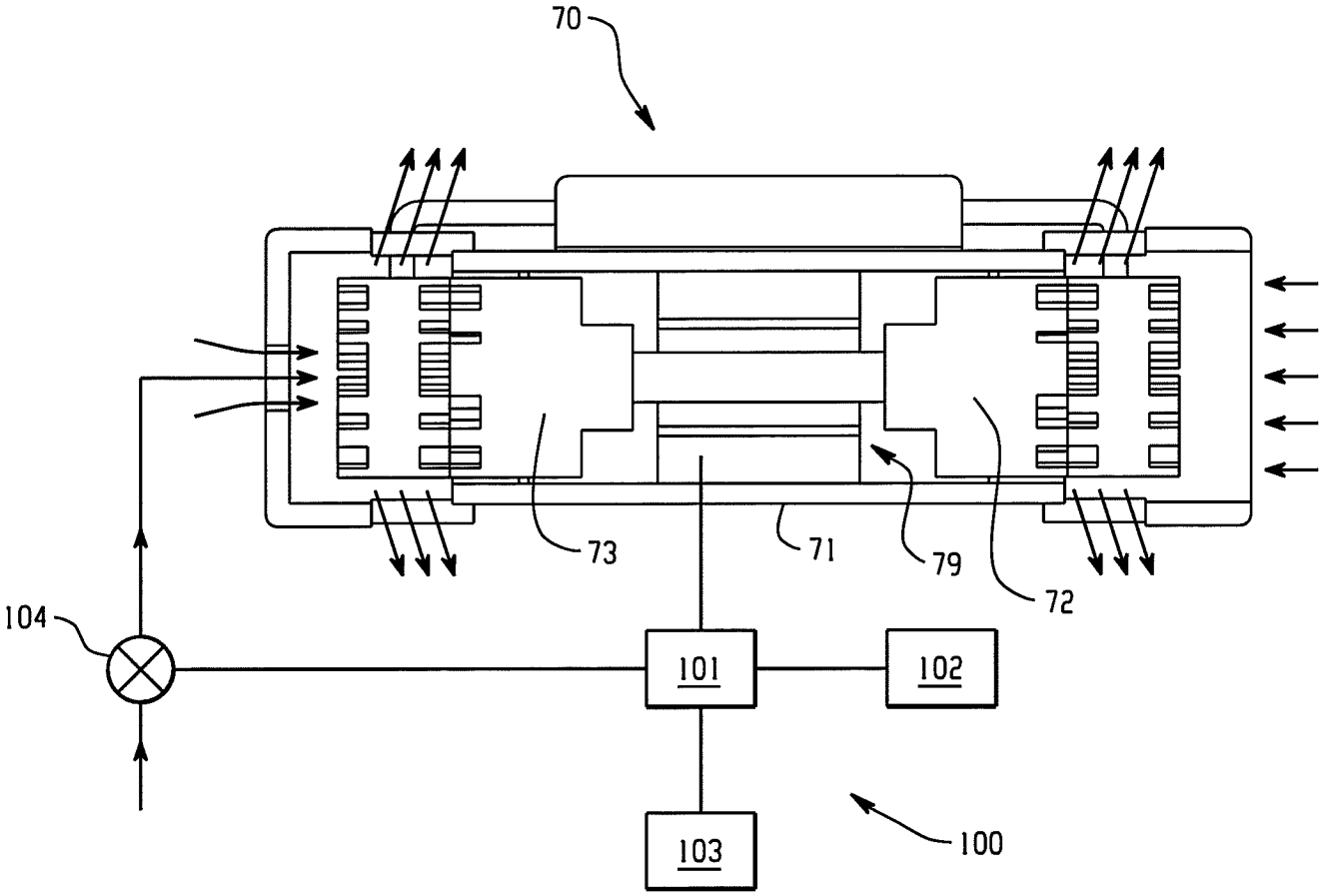
FIG. 5 illustrates a cross sectional view of the thermodynamic system of the present disclosure along with an exemplary wiring diagram of the controller system in accordance with one aspect of the present disclosure.

FIG. 5 shows the Ericsson cycle engine 70 with a control system 100. The control unit 101 communicates with the electric generator 79, fuel control valve 104, load buffer 102, and load 103. Further the control unit 101 controls the flow of energy between the electric generator 79, load buffer 102, and load 103. When the Ericsson cycle engine 70 is producing more power than is required by the load 103, the control unit can send a command to the fuel control valve 104 to reduce the flow of fuel. However, thermal lag effects can prevent the Ericsson cycle engine 70 from reducing power output as quickly as desired. In this case the control unit 101 will direct excess power to the load buffer 102. The load buffer 102 can be a resistor, battery, capacitor, flywheel, electrolytic cell, compressor and reservoir, or any other energy storage or dissipation device or combination thereof. For the cases where the load buffer 102 is an energy storage device, the control unit 101 can direct energy from the load buffer 102 to the load 103. This need can arise if the power demand from the load 103 exceeds the response time of the engine.

Various sensor types can be embedded, surface mounted or affixed in appropriate proximity to the Ericsson cycle engine 70 and communicate with the control unit 101. Examples of sensor types include pressure transducers, torque sensors, temperature sensors and others. The control unit 101 can be a single unit or multiple units that communicate with each other or act independently. The control unit 101, load buffer 102, fuel control valve 104, load 103 and sensors (not shown) can be electrical (e.g. analog or digital), mechanical, pneumatic, hydraulic, photonic, wireless or wired, or any other communication means or combination thereof. The fuel control valve 104 can control the fuel alone or oxidizer or fuel and oxidizer. In general, the fuel control valve 104 is any means of controlling thermal energy input or output from the engine.

Sensors associated with the Ericsson cycle engine, can operate in conjunction with the control unit 101, independent of the control unit, or in conjunction with each other. Some sensors can be used to protect the engine from damage if adverse conditions are detected or impending. For example, the generator can contain a thermal overload protector that contains a bimetal element that breaks an electrical circuit when a certain temperature is exceeded. As another example, the expander 73 could contain a thermal relief valve that opens if a certain temperature is exceeded. The open valve could direct gas into the interior portion of the housing 71 which in turn would activate the generator thermal protector.

There are in fact numerous sensors and protection devices employed on engines, compressors, refrigerators and the like that one skilled in the art would recognize as providing a similar function to the ones described herein.

Figure 6:
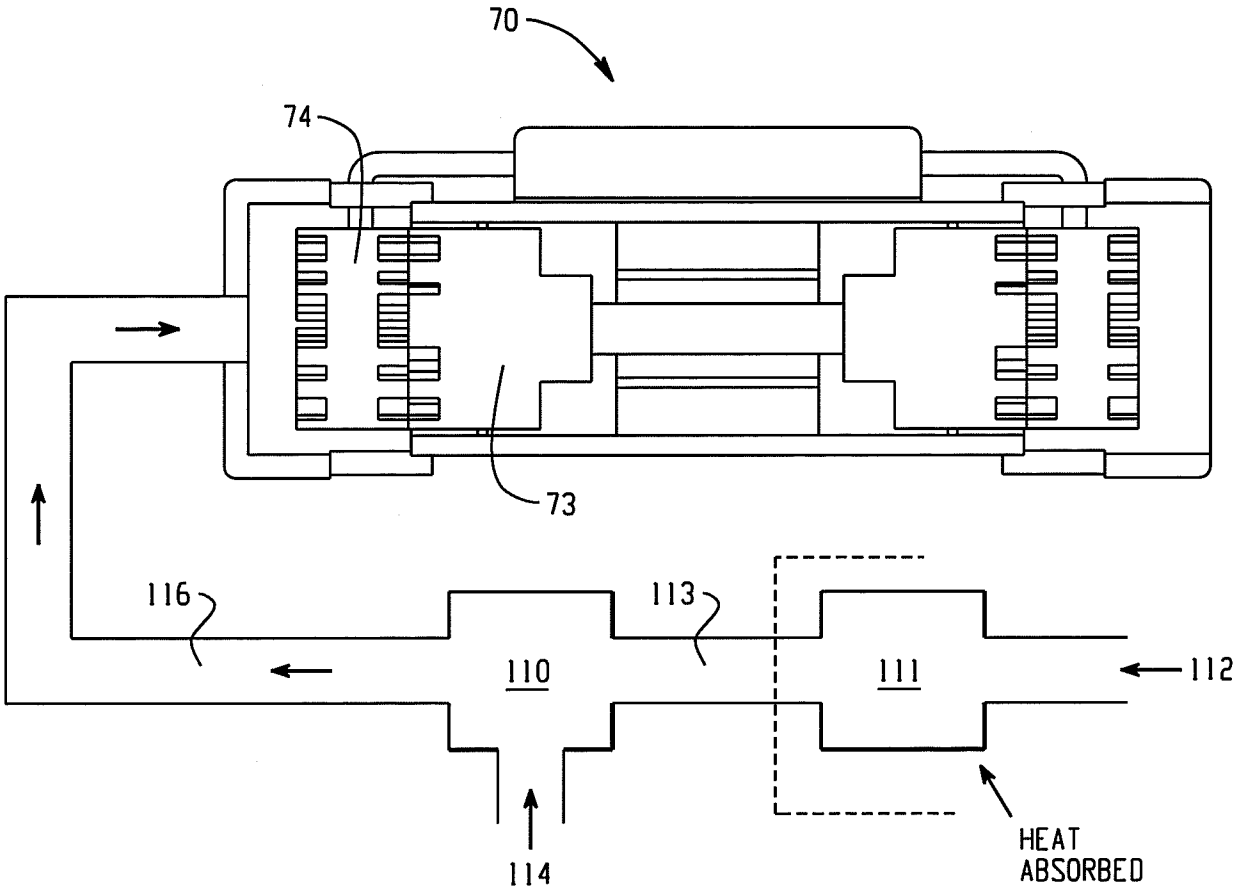
FIG. 6 illustrates a cross sectional view of the thermodynamic system of the present disclosure along with an external combustion flow diagram in accordance with one aspect of the present disclosure.

FIG. 6 shows the Ericsson cycle engine 70 with an external combustion chamber and optional preheater 111. An air stream 112 enters the preheater 111 where heat is absorbed by the air stream. The heat source can be provided by solar radiation, waste heat recovery, radioactive decay or any other means. The preheated air stream 113 exits the preheater 111 and enters the combustion chamber 110 where it is mixed with the fuel stream 114. The fuel and air mixture are reacted and the hot products 116 exit the combustion chamber and are directed to the hot heat exchanger 74 and expander 73. A pre-heater 111 can be used with an external combustion chamber as shown in FIG. 6 or an internal combustion chamber as shown in FIG. 4.

Figure 7:
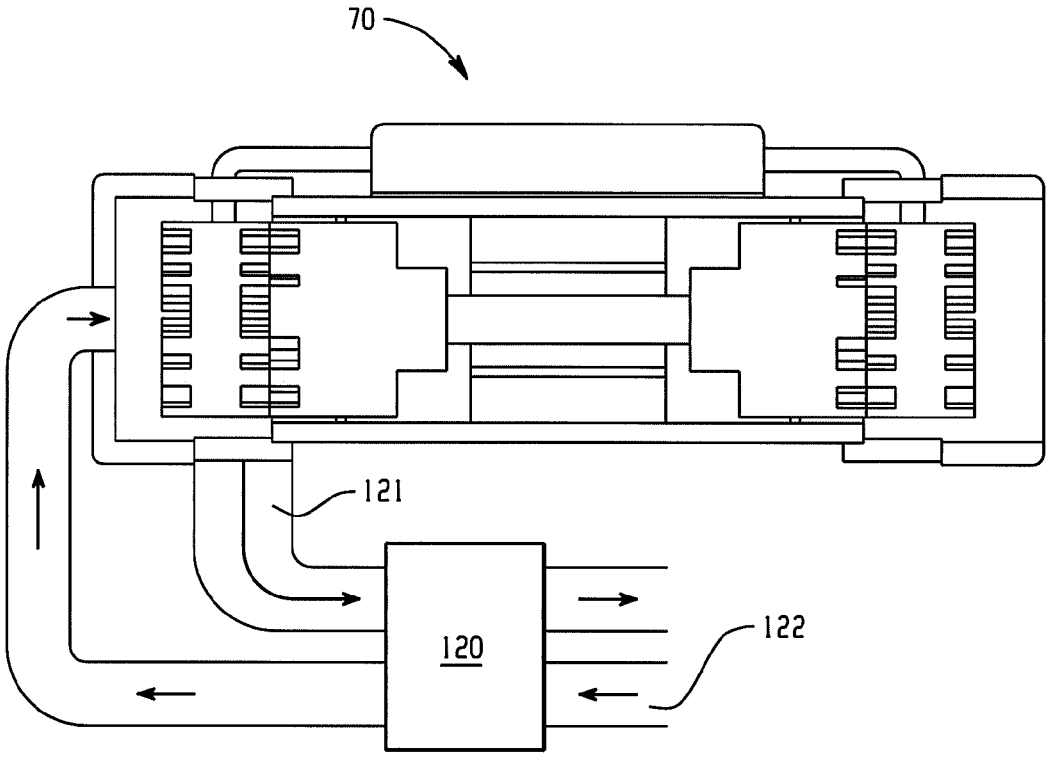
FIG. 7 illustrates a cross sectional view of the thermodynamic system of the present disclosure along with an external combustion flow diagram in accordance with one aspect of the present disclosure.

FIG. 7 shows the Ericsson cycle engine 70 with a combustion gas recuperator 120. The combustion product stream 121 will typically be a temperature significantly higher than the incoming reactant stream 122 prior to combustion. Dumping the heat from the product stream 121 to the environment results in a significant efficiency loss. The combustion gas recuperator 120 is a heat exchanger that transfers heat from the hot product stream 121 to the cooler reactant stream 122. This results in a reduction in the rate of fuel consumption required to maintain the desired temperature in the combustor.

Figure 8:
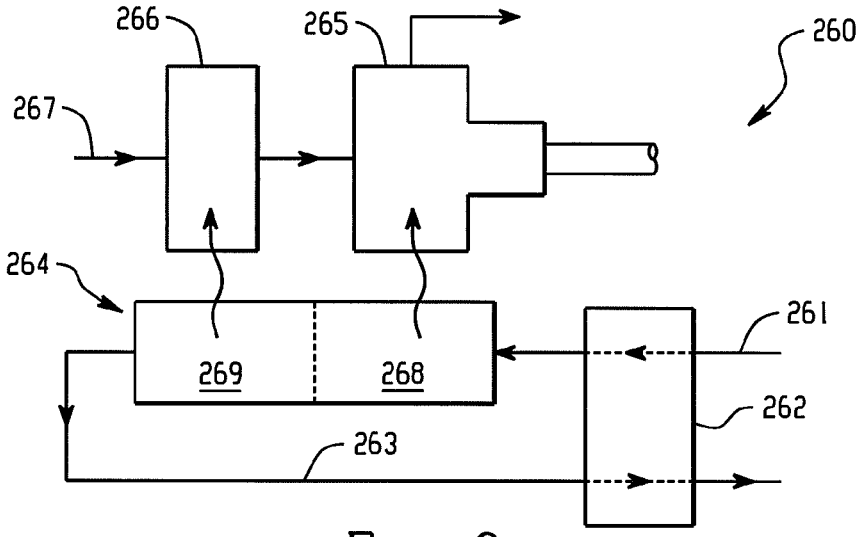
FIG. 8 shows a method for transferring heat to the Ericsson cycle engine that optimizes engine efficiency.

A method 260 for transferring heat to the Ericsson cycle engine that optimizes engine efficiency is shown in FIG. 8. A low temperature reactant stream 261 enters recuperator 262 where it gains heat from the relatively high temperature product stream 263. The reactant stream reacts (burns) in the combustion chamber 264. Heat from an uspsteam portion 268 of the combustion chamber 264 is transferred to the expander 265. The temperature of the product gases in the upstream portion 268 of the combustion chamber 264 is higher than that in the downstream portion 269. The hot side heat exchanger 266 absorbs heat from the downstream portion 269 of the combustion chamber 264. The arrangement between the combustion chamber 264, expander 265 and hot heat exchanger 266 is essentially that of a counterflow heat exchanger, which has advantages known in the art. For example, compared to other arrangements, a counterflow heat exchanger requires less heat transfer area to achieve a prescribed heat transfer rate.

Figure 9:
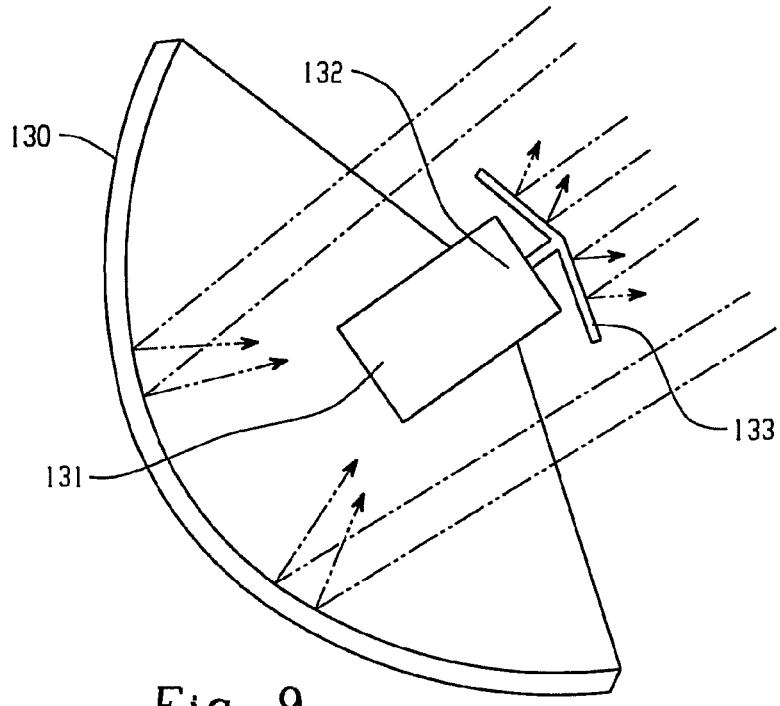
FIG. 9 illustrates a plan view of the thermodynamic system of the present disclosure along with a parabolic heat collector.

FIG. 9 shows the Ericsson cycle engine 70 connected to a parabolic collector 130. The collector 130 focuses solar radiation or radiation from other sources onto the hot side 131 of the Ericsson cycle engine 70. The cool side 132 of the engine has a reflector 133 that prevents incident radiation from inadvertently heating the cool side 132.

Figure 10:
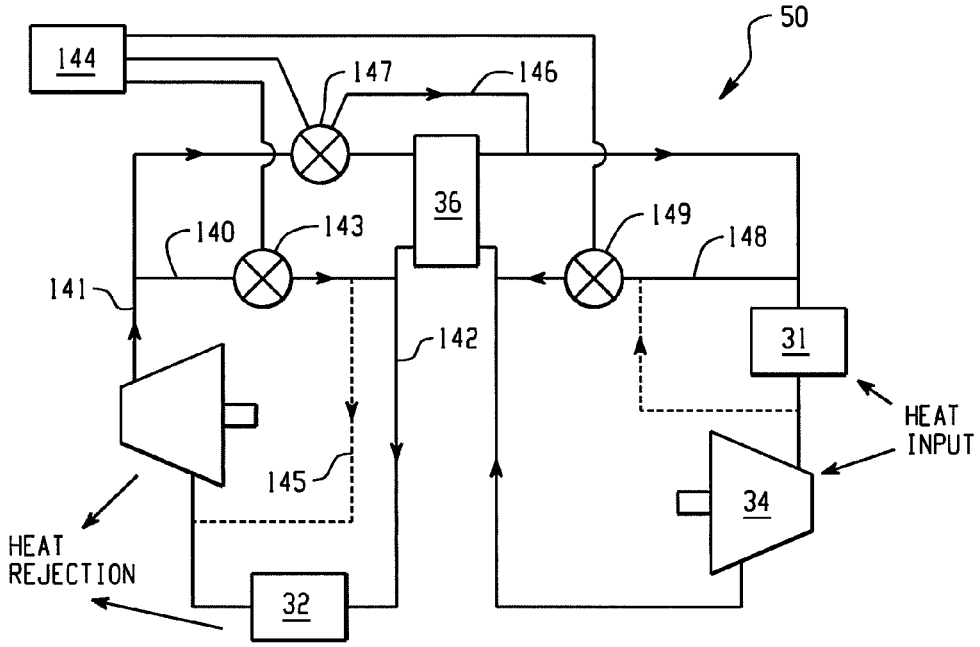
FIG. 10 is a schematic illustration of an embodiment of the thermodynamic system of the present disclosure illustrating power control with bypass lines.

FIG. 10 shows an embodiment of the Ericsson cycle engine 50 with a plurality of output power control methods. Any of these methods may be used alone or in conjunction with any other output power control means. In a first method a bypass line 140 is in fluid communication with the compressor outlet stream 141 and the cold heat exchanger inlet stream 142. A valve means 143 is located in the bypass line 140 to control flow through the bypass line 140. A control means 144 controls the opening and closing of the valve 143 including proportional control which permits the valve 143 to be neither fully opened nor fully closed. An alternate flow path 145 bypasses the cold heat exchanger 32. The net effect of opening the valve means 143 is to quickly reduce gas flow to the expander 34, which reduces power output.

In a second method a bypass line 146 bypasses flow through the high pressure side of the regenerator 36. A valve means 147 selectively directs flow through the bypass line 146. The valve is controlled by control means 144. Opening of valve means 147 results in relatively cool gas entering the expander 34, which quickly reduces power output of the engine. Alternatively, a bypass line and valve means could be inserted to redirect flow, or a portion of the flow, around the low pressure side of the recuperator. That is, from the expander 34 outlet to the cold heat exchanger inlet stream 142.

In a third method a bypass line 148 is in fluid communication with the hot heat exchanger 31 inlet and expander 34 outlet. A valve means 149 is located in the bypass line 148 to control flow in the bypass line 148. A control means 144 selectively controls opening and closing of valve means 149. Alternately, the bypass line 148 including valve means 149 can connect between the expander 34 inlet and expander 34 outlet. The effect of opening valve means 149 is to reduce the flow rate through the expander 34, which quickly reduces power output of the engine.

Figure 11:
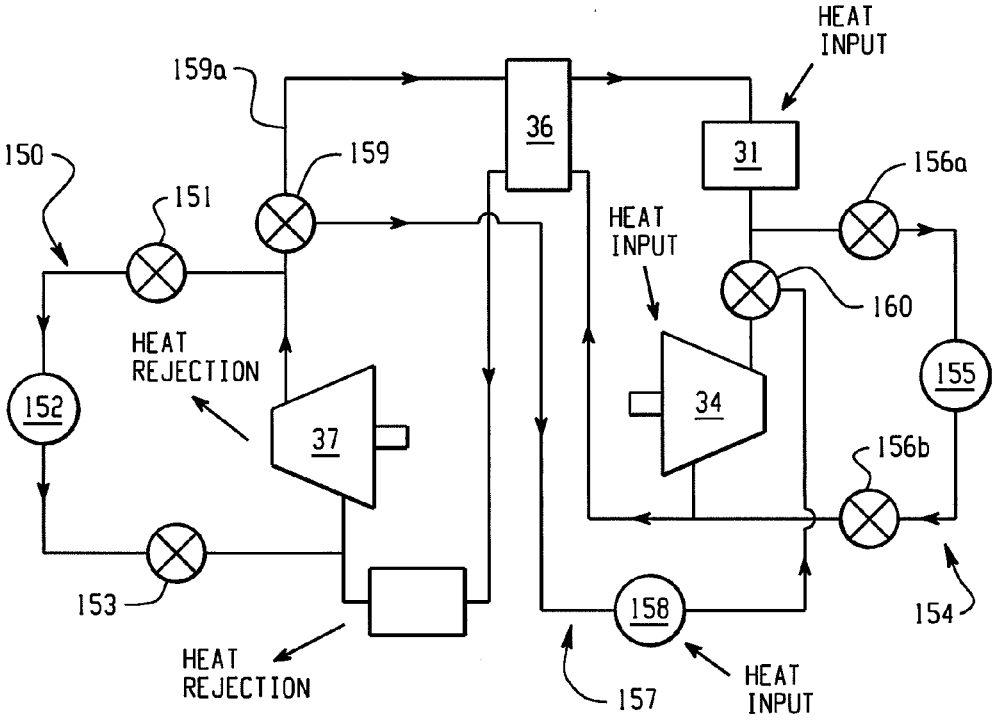
FIG. 11 is a schematic illustration of another embodiment of the thermodynamic system of the present disclosure illustrating power control with bypass and reservoir lines.

FIG. 11 shows an embodiment of the Ericsson cycle engine 50 with a plurality of output power control methods. Any of these methods may be used alone or in conjunction with any other output power control means. In a first method, bypass line 150 is connected across the compressor 37 inlet and outlet. The bypass line 150 is in fluid communication with a fluid reservoir 152. A valve means 151 selectively allows flow into the fluid reservoir 152 while a valve means 153 selectively controls flow out of the fluid reservoir 152. A control means (not shown) controls operation of the valves. To reduce engine power valve means 151 is opened and fluid reservoir 152 is filled or partially filled. This results in reduced mass flow through the expander 34, which reduces engine power output. Reduced engine power output will persist even after valve means 151 is closed since a portion of the system working fluid will be trapped in fluid reservoir 152. This is more efficient than continually bypassing compressor 37 gas flow from outlet to inlet since the mass flow rate through the compressor is also reduced. When additional engine power is needed, valve means 153 is opened and the excess gas in fluid reservoir 152 is returned to the system, due to the pressure differential between the compressor 37 inlet and outlet.

In a second method, bypass line 154 is connected across the expander 34 inlet and outlet. The bypass line is in fluid communication with a fluid reservoir 155. A valve means 156*a* selectively allows flow into the fluid reservoir 155 while a valve means 156*b* selectively controls flow out of the fluid reservoir 155. A control means (not shown) controls operation of the valves 156*a*, 156*b*. To reduce engine power, valve means 156*a* is opened and fluid reservoir 155 is filled or partially filled. This results in reduced mass flow through the expander 34, which reduces engine power output. Reduced engine power output will persist even after valve means 156*a* is closed since a portion of the system working fluid will be trapped in fluid reservoir 155. This is more efficient than continually bypassing expander 34 gas flow from inlet to outlet since the mass flow rate through the compressor is also reduced. When additional engine power is needed, valve means 156*b* is opened and the excess gas in fluid reservoir 155 is returned to the system, due to the pressure differential between the expander 34 inlet and outlet.

In a third method, bypass line 157 is connected from the compressor 37 outlet to the expander 34 inlet. The bypass line is in fluid communication with a fluid reservoir 158. A valve means 159 selectively allows flow into the fluid reservoir 158 while a valve means 160 selectively controls flow out of the fluid reservoir 158. A control means (not shown) controls operation of the valves 159, 160. To reduce engine power, valve means 159 diverts compressor 37 outlet flow to the fluid reservoir 158, which reduces flow through the expander 34, which reduces engine power output. Reduced engine power output will persist even after valve means 159 is closed since a portion of the system working fluid will be trapped in fluid reservoir 158. Fluid reservoir 158 receives a heat input, which increase the pressure of the gas in the reservoir when valve means 159 and 160 are closed. When valve means 160 is opened, high pressure hot gas from fluid reservoir 158 enters the expander 34 inlet, resulting in a rapid boost in engine output power. The control scheme of valves 159 and 160 can be changed to provide alternate techniques for quickly reducing or increasing power output of the engine. For example valve means 159 can be a multi-way valve. In this mode of operation valve 159 can direct flow to fluid reservoir 158 while restricting flow from the compressor 37 to the recuperator 36 inlet. The pressure of the gas in fluid reservoir 158 could be made substantially higher than the normal compressor 37 outlet pressure. Valve 159 can be returned to a "normal" position leaving a portion of the system working fluid in fluid reservoir in 158 while allowing the compressor 37 outlet flow to enter the recuperator 36. An engine power increase can then be achieved by returning the trapped working fluid to the system via valves 159 or 160. A similar effect can be achieved with fluid reservoirs 152 and 155. For example, as shown in FIG. 11 valve 151 is positioned to "allow" flow into fluid reservoir 152. This limits the maximum pressure in fluid reservoir 152 to that of flow stream 159*a*. However, valve 151 can be repositioned to "divert" flow from flow stream 159*a* to bypass line 150. This makes it possible to get a pressure in fluid reservoir 152 that is higher than the pressure in gas stream 159*a*. Therefore a greater reduction in engine output power can be achieved. The working fluid in fluid reservoir 152 can be returned to flow stream 159*a* via valve 151, which will increase engine output. With regard to fluid reservoir 155, the same functionality is achieved by opening and closing valve 160 to divert flow.

The relatively high pressure gas that is contained in fluid reservoirs 152, 155, and 158 could alternately be used to start the engine. When the engine is shutdown, the engines working fluid will eventually come into thermal equilibrium with the surrounds. The internal pressures will also equalize unless a specific means, such as valves, are used to prevent this. Simply providing a heat input to the expander 34 and hot heat exchanger may not be sufficient to make the engine start (e.g. begin shaft rotation). When properly designed, releasing high pressure gas from fluid reservoirs 152, 155 or 158 into the expander 34 inlet will be sufficient to drive the expander 34 momentarily so that the engine can continue to operate as previously described.

It should be evident that one skilled in the art could contrive any number of alternate bypass arrangements that are substantially similar and have substantially similar results to those disclosed herein.

Figure 12:
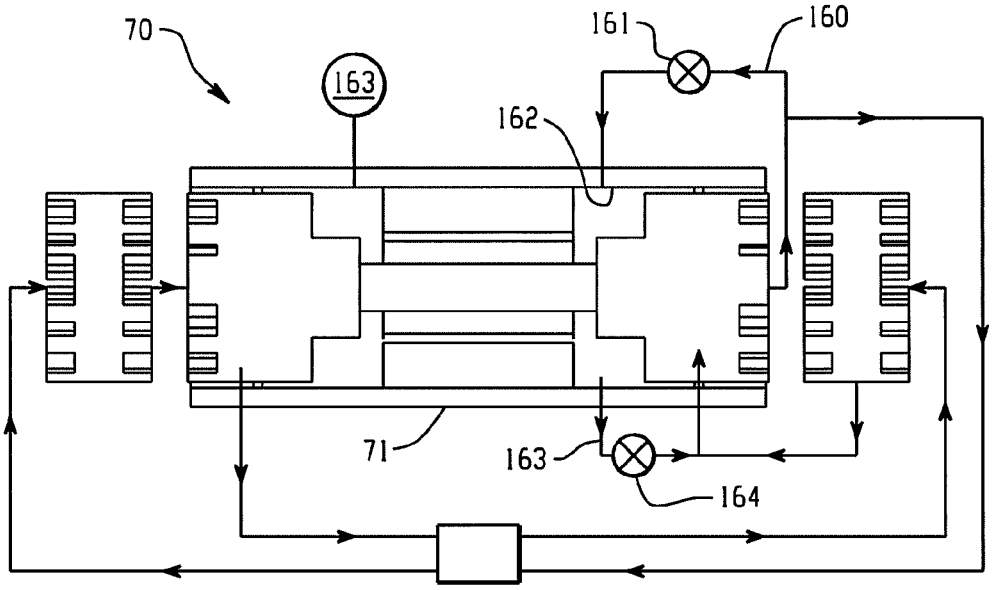
FIG. 12 illustrates a cross sectional view of the thermodynamic system of the present disclosure along with a schematic gas flow diagram in accordance with one aspect of the present disclosure.

FIG. 12 shows a partially exploded view of Ericsson cycle engine 70 with flow streams represented schematically. This embodiment illustrates that the housing 71 is also used as a fluid reservoir for power output control. Specifically, the bypass line 160 with valve means 161 routes gas to a sealed interior portion 162 of housing 71. The optional auxiliary fluid reservoir 162 can be used to increase the total volume of the reservoir. Return bypass line 163 with valve means 164 is used to return gas in the fluid reservoir 162 to the compressor 72 inlet. The operating principle is the same as that described as the first method with respect to FIG. 11. The housing 71 can also be used as a fluid reservoir with the other methods as previously described.

Figure 13:
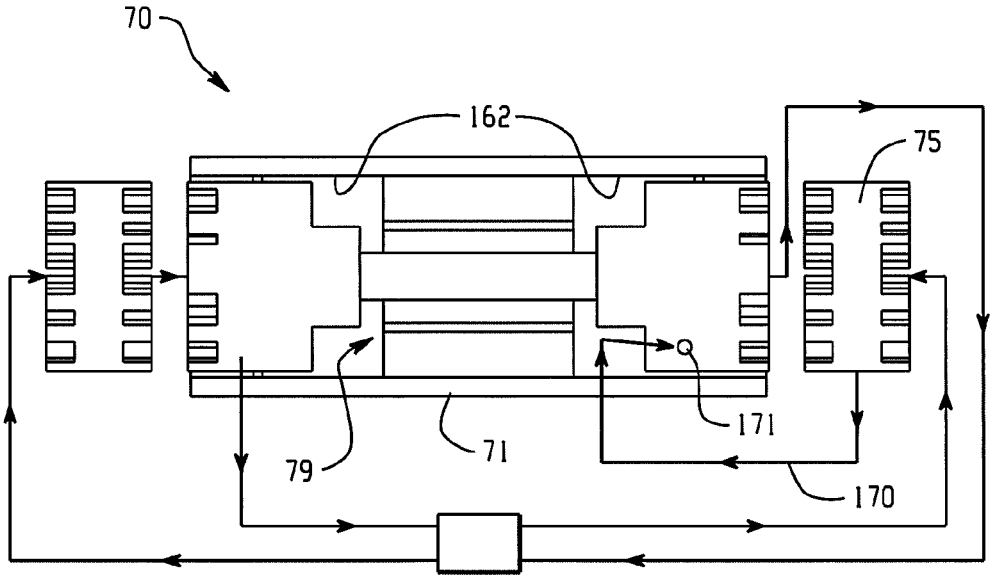
FIG. 13 illustrates a cross sectional view of the thermodynamic system of the present disclosure along with a schematic gas flow diagram in accordance with another aspect of the present disclosure.

FIG. 13 shows a partially exploded view of Ericsson cycle engine 70 with flow streams represented schematically. This embodiment illustrates that the housing 71 is used as a working fluid reservoir. In the embodiment shown, the relatively cool low pressure gas stream 170 exiting the cold heat exchanger 75 flows into the interior portion 162 of the housing. The inlet 171 of compressor 72 is in fluid communication with the interior portion 167 of the housing 71 such that the compressor 72 draws gas in from the interior portion 162 of the housing. Note that the electric generator 79 divides the interior portion 162 of the housing into two chambers, but these chambers are in fluid communication via the gap between the rotor 78*b* and stator 79*a* and via other flow passages (not shown) such that the interior portion 162 of the housing is considered a single fluid volume. Gas stream 170 can penetrate the housing at any desired location.

A benefit of using the housing 71 as a fluid volume as described above is that the incoming gas will cool the electric generator 79, which will improve reliability and efficiency. In addition to motor cooling, exposing the interior portion 162 of the housing to the working gas has additional advantages. For example, if the interior portion of the housing was exposed to ambient air or was sealed and evacuated, shaft seals and other seal means would be required to keep the working fluid from leaking into the interior portion 162 of the housing 71. This would negatively impact performance. By filling this space with working fluid to an appropriate pressure, leakage of working fluid into the interior portion 162 of the housing 71 is reduced or eliminated. This advantage can be realized by equalizing the pressure of the interior portion 162 of the housing 71 with any flow path in the system, including an intermediate pressure within the compression or expansion process.

Figure 14:
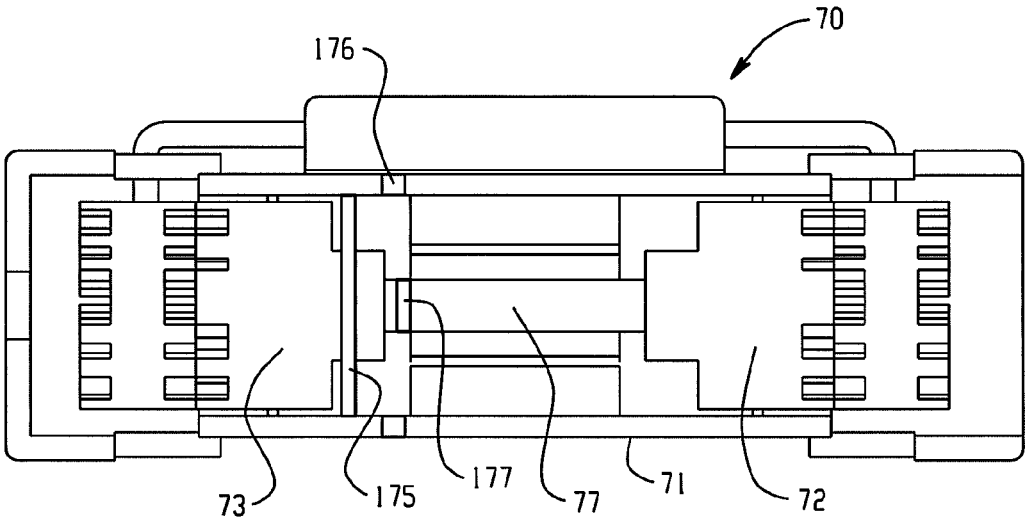
FIG. 14 illustrates a cross sectional view of the thermodynamic system of the present disclosure along with thermal insulators.

FIG. 14 shows the Ericsson cycle engine 70 with thermal insulation. For efficient operation a large temperature difference between the hot and cold sides of the engine is desirable. The relative close proximity of the expander 73 to the compressor 72, the use of a common shaft 77, and a common housing enclosing the compressor 72 and expander 73 can result in significant heat leakage from the expander 73 to the compressor 72. To prevent heat leakage, thermal insulation 175 is employed to reduce the rate of heat transfer (radiation, convection, and conduction) between these components. Thermal insulation 175 reduces heat transfer primarily from the expander 73 to gas in the interior portion 162 of the housing 71. Ideally the housing 71 and shaft 77 are constructed of thermal insulator materials such as engineering ceramics. However, cost constraints could limit the use of such materials. Also, such materials may not have other desirable thermophysical properties. In such a case, heat transfer in the shaft 77 and housing 71 can be reduced by inserting interstitial thermal insulators 176 and 177.

Figure 15:
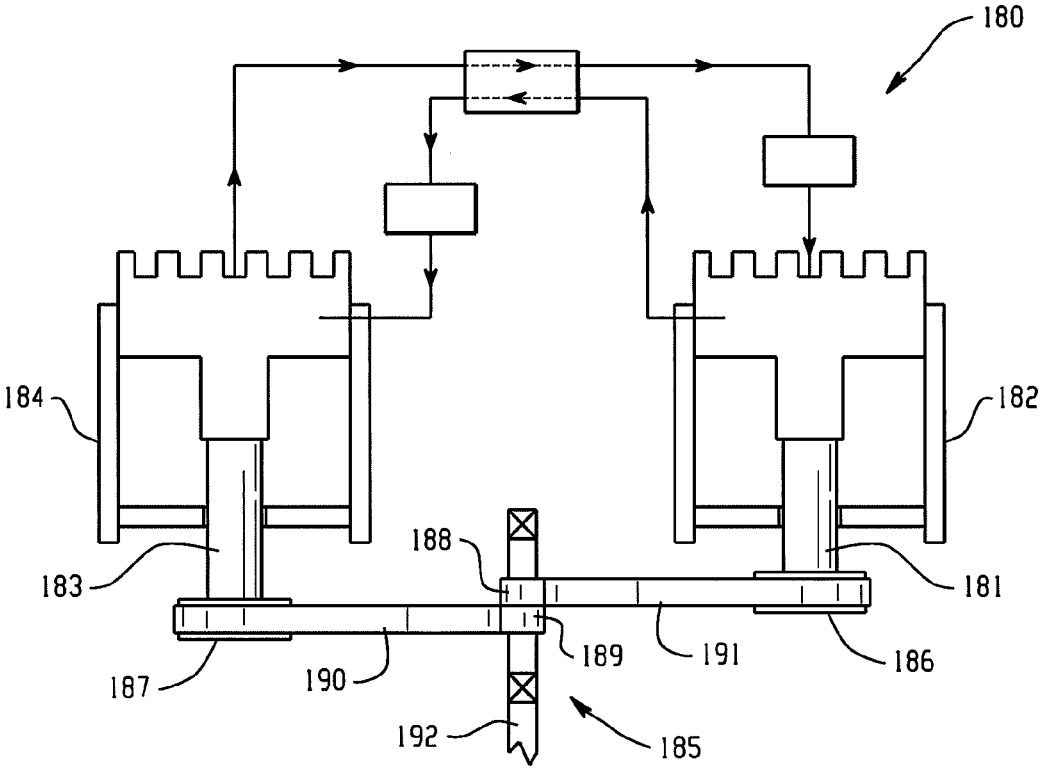
FIG. 15 illustrates a cross sectional view of another embodiment of the thermodynamic system of the present disclosure along with a schematic gas flow diagram in accordance with one aspect of the present disclosure.

In certain applications it may be undesirable for the Ericsson cycle engine or refrigerator to be configured in a hermetic arrangement on a common shaft. For example, for certain applications it may be desirable to generate rotary shaft power instead of electrical power. FIG. 15 discloses an Ericsson cycle engine 180 device with a rotary shaft power output. In this embodiment an expander shaft 181 protrudes from the expander housing 182. Similarly, a compressor shaft 183 protrudes from the compressor housing 184. Shafts 181 and 182 are coupled by means of transmission 185. The transmission as shown in FIG. 15 is comprised of pulleys 186, 187, 188, 189; belts 190, 191 and shaft 192, which can be attached to a load. The transmission could be of numerous types known in the art, including methods that allow the gear ratio between shaft 181 and 183 to be varied. A variable transmission provides several potential advantages. For example, the optimal ratio of volumetric displacement rates between the compressor and expander can vary with load and other operating conditions. The transmission provides a means of varying displacement rates, by controlling the speeds of shaft 181 and shaft 183.

FIG. 15. illustrates the use of a transmission in a non-hermetic design. However, a transmission could also be adapted for use on a hermetic design with an integral generator.

Figure 16:
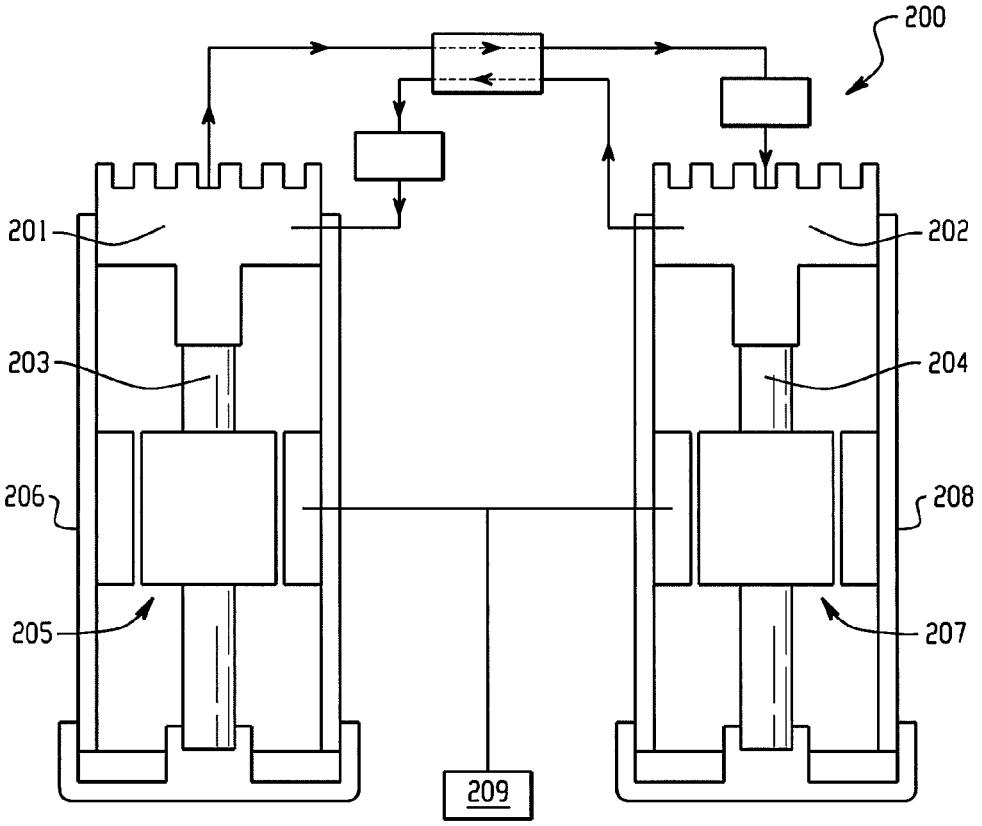
FIG. 16 illustrates a cross sectional view of another embodiment of the thermodynamic system of the present disclosure along with a schematic gas flow diagram in accordance with another aspect of the present disclosure.

FIG. 16 shows an embodiment of an Ericsson cycle engine 200 where the compressor and expander operate on separate shafts. The compressor 201, and electric motor 205 are contained in housing 206, which is preferably hermetic. The expander 202 and electric generator are contained in housing 208, which is preferably hermetic. A control means, load, and load buffering are generically represented as box 209. Heat input and rejection means are left off for clarity. The arrangement shown has several potential advantages. For example, the speed of compressor 201 and expander 202 are independent. Therefore, volumetric displacement rates can be varied without a mechanical transmission. Also, in certain applications it may be desirable to arrange the compressor 201 and expander 202 in a manner that would be difficult to accommodate using a single shaft or mechanical transmission.

Figure 17:
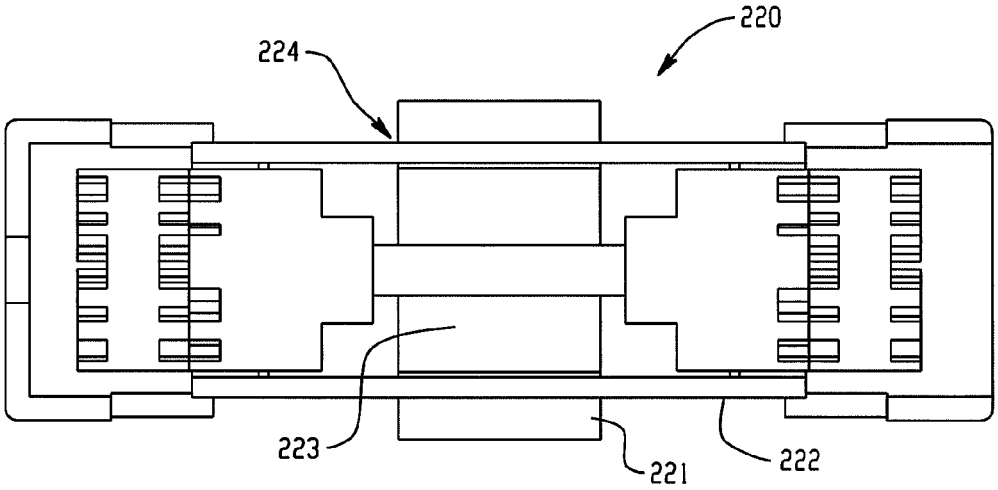
FIG. 17 illustrates a cross sectional view of another embodiment of the thermodynamic system of the present disclosure along with a generator configuration.

FIG. 17 shows an embodiment of an Ericsson cycle engine 220 where the motor stator is external to the hermetic engine housing 222. The motor rotor 223 is contained in the housing 222. The housing 222 material in the area around the motor 224 should ideally be constructed of a low loss material (e.g. an electrical insulator). This arrangement has advantages with respect to cooling the motor stator 221. For example, ambient air could be circulated around the motor stator 221 to provide cooling.

Figure 18:
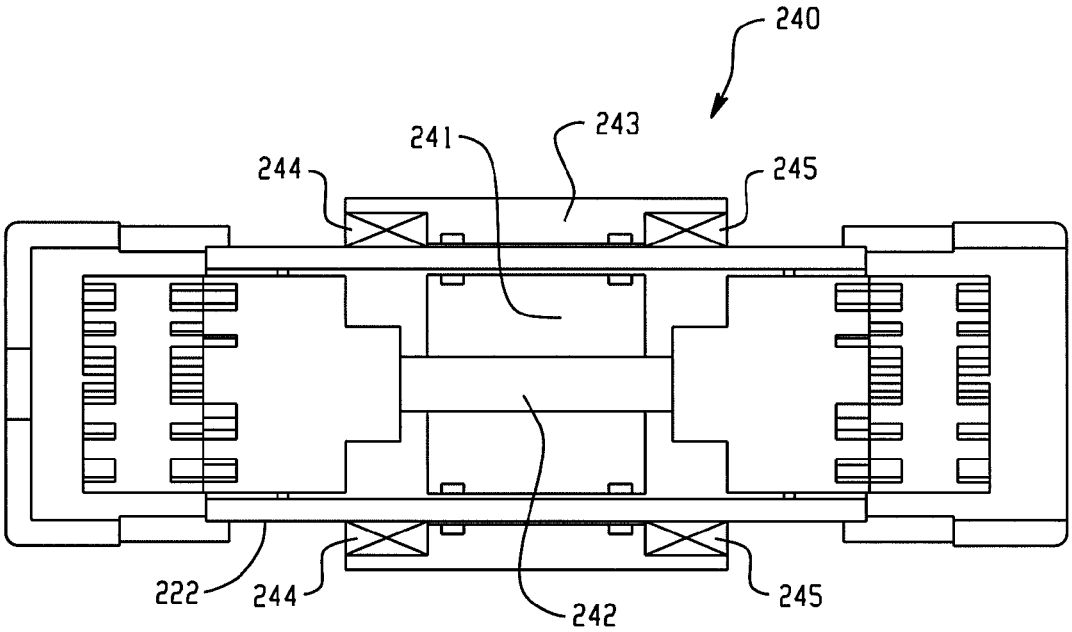
FIG. 18 illustrates a cross sectional view of another embodiment of the thermodynamic system of the present disclosure along with a magnetic power transmission configuration.

FIG. 18 shows an embodiment of an Ericsson cycle engine 220 that is conceptually similar to Ericsson cycle engine of FIG. 17. In this embodiment a master rotor 241 is mated with shaft 242. A slave rotor 243 is rotatably supported on engine housing 222, via bearing supports 244 and 245. Master rotor 241 and slave rotor 242 contain magnets, electromagnets or are magnetic as an integral part of their construction. The magnetic poles are aligned so that magnetic force between the master rotor 241 and slave rotor 242 causes them to rotate together with minimal slippage. The slave rotor 242 can be connected to a load by various means known in the art. This arrangement makes possible a hermetic design with direct mechanical work output.

This disclosure has been described with reference to the preferred embodiments. Obviously, modifications and alterations will occur to others upon reading and understanding the preceding detailed description. It is intended that the exemplary embodiments be construed as including all such modifications and alternations insofar as they come within the scope of the appended claims or the equivalents thereof.

What is claimed is:

1. A thermodynamic system that approximates an Ericsson cycle comprising:

a compressor configured to compress a fluid, said compressor configured to reject heat from the fluid such that isothermal compression is approached;

an expander configured to expand the fluid, said expander configured to introduce heat to the fluid such that isothermal expansion is approached;

a recuperator in fluid communication with the compressor and expander configured to transfer heat between the fluid received from the compressor and the fluid received from the expander and wherein the thermodynamic system is a micro scale device, wherein the micro scale compressor ranges from about 0.1 mm to about 5 cm and a system power ranges from about 0.1 W to 250 W; and a controller configured to control a level of power of the system.

2. The thermodynamic system of claim 1 operating in a forward sense so that a net power output is achieved.

3. The thermodynamic system of claim 1 operating in a reverse sense so that a net refrigeration effect is achieved.

4. The thermodynamic system of claim 1 further comprising either or both of a first heat exchanger for rejecting heat from the fluid entering the compressor and a second heat exchanger for introducing heat to the fluid entering the expander.

5. The thermodynamic system of claim 3 further comprising either or both of a first heat exchanger for introducing heat to the fluid exiting the expander and a second heat exchanger for rejecting heat from the fluid exiting the compressor.

6. The thermodynamic system of claim 1 wherein the controller is configured to manipulate the output power of the system by adjusting flow of the fluid among the compressor, expander, and the recuperator.

7. The thermodynamic system of claim 1 where the compressor is a scroll compressor.

8. The thermodynamic system of claim 1 where the expander is a scroll expander.

9. The thermodynamic system of claim 1 further comprising a housing for containing the compressor and expander such that a seal is formed around a periphery of the compressor and expander.

10. The thermodynamic system of claim 1 further comprising a common rotatable shaft mated between the compressor and the expander.

11. The thermodynamic system of claim 4 further comprising: a combustion chamber configured to introduce heat to at least one of the hot heat exchanger and the expander; and a cooling chamber configured to introduce a cooling fluid to at least one of the cold heat exchanger and the compressor.

12. The thermodynamic system of claim 11 wherein the combustion chamber is enclosed within the housing.

13. The thermodynamic system of claim 11 wherein the combustion chamber is located exterior to the housing.

14. The thermodynamic system of claim 11 further comprising a combustion gas recuperator adapted to transfer heat from a combustion product stream to an incoming reactant stream prior to being introduced to the combustion chamber.

15. The thermodynamic system of claim 4 further comprising a collector that is configured to focus heat in the form of radiation to at least one of the expander and hot heat exchanger.

16. A thermodynamic system that approximates an Ericsson cycle comprising:

a compressor configured to compress a fluid, said compressor configured to reject heat from the fluid such that isothermal compression is approached;

an expander configured to expand the fluid, said expander configured to introduce heat to the fluid such that isothermal expansion is approached;

a recuperator in fluid communication with the compressor and expander configured to transfer heat between the fluid received from the compressor and the fluid received from the expander and wherein the thermodynamic system is a micro scale device;

either or both of a first heat exchanger for rejecting heat from the fluid entering the compressor and a second heat exchanger for introducing heat to the fluid entering the expander; and a controller configured to control a level of power of the system, wherein the controller is configured to manipulate the output-power of the system by adjusting flow of the fluid through at least one bypass line by modulating at least one of a first valve between an inlet of the compressor and an outlet of the first heat exchanger, a second valve between a first side and a second side of the recuperator, and a third valve between an inlet of the second heat exchanger and an outlet of the expander.

17. A thermodynamic system that approximates an Ericsson cycle comprising:

a compressor configured to compress a fluid, said compressor configured to reject heat from the fluid such that isothermal compression is approached;

an expander configured to expand the fluid, said expander configured to introduce heat to the fluid such that isothermal expansion is approached;

a recuperator in fluid communication with the compressor and expander configured to transfer heat between the fluid received from the compressor and the fluid received from the expander and wherein the thermodynamic system is a micro scale device;

either or both of a first heat exchanger for rejecting heat from the fluid entering the compressor and a second heat exchanger for introducing heat to the fluid entering the expander; and a controller configured to control a level of power of the system, wherein the controller is configured to manipulate the output power of the system by adjusting flow of fluid through at least one bypass and reservoir line by modulating a first valve on a first side of a reservoir and a second valve on a second side of the reservoir such that output power is reduced when the first valve is opened to at least partially fill the reservoir and output power is increased when the second valve is opened to at least partially release fluid from the reservoir.

18. The thermodynamic system of claim 17 wherein at least one of a first bypass is connected across an input and an output of the compressor, a second bypass is connected across an inlet and an outlet of the expander, and a third bypass is connected across the outlet of the compressor and the inlet of the expander.

19. The thermodynamic system of claim 18 wherein a housing includes a sealed interior portion configured for use as the reservoir for fluid that flows through at least one bypass.

20. The thermodynamic system of claim 17 wherein a housing includes a sealed interior portion configured for use as the reservoir for the fluid that flows through at least one of the first, second, and third bypasses.

21. The thermodynamic system of claim 1 wherein the controller is configured to manipulate the power of the system by diverting flow from a relatively high pressure area of the system to a reservoir to reduce output power, and to return fluid from the reservoir to high or low pressure area of the system to increase output power.

22. The thermodynamic system of claim 1 wherein the controller is configured to manipulate the power of the system by restricting flow in a fluid line of the system to cause a pressure drop to reduce output power and minimizing the restriction to increase output power.

23. The thermodynamic system of claim 6 wherein the controller is configured to manipulate the power of the system by adjusting flow of the fluid through at least one bypass line located between a relatively high pressure area of the system and a relatively low pressure area of the system by modulating at least one valve.

24. The thermodynamic system of claim 9 wherein an electric generator is located within the sealed interior portion of the housing.

25. The thermodynamic system of claim 24 wherein fluid within the sealed interior portion absorbs heat produced by the generator.

26. A thermodynamic system that approximates an Ericsson cycle comprising: a compressor configured to compress a fluid, said compressor configured to reject heat from the fluid such that isothermal compression is approached; an expander configured to expand the fluid, said expander configured to introduce heat to the fluid such that isothermal expansion is approached; a recuperator in fluid communication with the compressor and expander configured to transfer heat between the fluid received from the compressor and the fluid received from the expander and wherein the thermodynamic system is a micro scale device, wherein the micro scale compressor ranges from about 0.1 mm to about 5 cm and a system power ranges from about 0.1 W to 250 W; and a controller configured to control a level of power output of the system and wherein the controller is configured to equalize the pressure of the fluid within at least the sealed interior portion of the housing, the compressor, and the expander.

27. The thermodynamic system of claim 9 wherein the housing includes thermal insulators that are configured to reduce the transfer of heat from the hotter side of the system to the colder side of the system, wherein for engine operation the expander and second heat exchanger are hotter than the compressor and first heat exchanger, and wherein for refrigerator operation the compressor and second heat exchanger are hotter than the expander and first heat exchanger.

28. A thermodynamic system that approximates an Ericsson cycle comprising: a compressor configured to compress a fluid, said compressor configured to reject heat from the fluid such that isothermal compression is approached; an expander configured to expand the fluid, said expander configured to introduce heat to the fluid such that isothermal expansion is approached; a recuperator in fluid communication with the compressor and expander configured to transfer heat between the fluid received from the compressor and the fluid received from the expander and wherein the thermodynamic system is a micro scale device;

a controller configured to control a level of power of the system; and a solid lubricant used to lubricate system components by circulating within the system to continuously lubricate system components.

29. The thermodynamic system of claim 1 containing at least one sensor.

30. The thermodynamic system of claim 29 wherein plural sensors provide data to the controller.

31. The thermodynamic system of claim 29 wherein one or more of said sensors sense and respond to a condition of the system independent of the controller.

32. The thermodynamic system of claim 2 wherein heat rejected from the device is absorbed by the fuel such that the fuel is heated or vaporized.

33. The thermodynamic system of claim 28 further comprising a controller configured to manipulate the output power of the system by adjusting flow of the fluid among the compressor, expander, and the recuperator.

* * * * *